United States Patent [19]

Lambiris

[11] Patent Number: 4,651,861

[45] Date of Patent: Mar. 24, 1987

[54] COIN SLIDE JAMMING MECHANISM

[75] Inventor: Christos Lambiris, New York, N.Y.

[73] Assignee: Kidde, Inc., Brooklyn, N.Y.

[21] Appl. No.: 692,390

[22] Filed: Jan. 17, 1985

[51] Int. Cl.[4] ..... G07F 5/02; G07F 9/00

[52] U.S. Cl. ..... 194/204; 194/235

[58] Field of Search ..... 194/1 E, 1 G, 55, 92, 194/93, 97 R, 202, 204, 235

[56] References Cited

U.S. PATENT DOCUMENTS 673,800 5/1901 Romans et al. ..... 194/93

*Primary Examiner*—F. J. Bartuska

*Attorney, Agent, or Firm*—Darby & Darby

[57] ABSTRACT

A jamming mechanism for a coin-operated vending machine has a first slide member movable between a normal checked position in which the vending machine is locked out of service and a coin-activated operative position in which the vending machine is placed in service. A second slide member engageable by a user of the vending machine is releasably interconnected by a breakable element to the first slide to prevent relative movement therebetween in the absence of predetermined force applied to the second slide to break the breakable element. The second slide can thus normally be used to control the movement of the first slide from the checked position to the operative position when the proper coins are inserted. If excessive force is applied, the breakable element breaks and a spring-loaded stop pin extends from the first slide to engage the body of coin mechanism to prevent movement of the first slide.

5 Claims, 4 Drawing Figures

COIN SLIDE JAMMING MECHANISM

BACKGROUND OF THE INVENTION

The present invention relates generally to coin slide devices that are used in the vending machine industry, and in particular to a novel and highly effective jamming mechanism for such devices.

Slide mechanisms are commonly used in connection with machines for which a coin or a multiple number of coins must be utilized to effect a particular vending operation such as placing a laundry machine in service. Such equipment is placed in public locations that often cannot be adequately supervised to protect against attempts to obtain the services of the vending equipment without pay.

In a typical machine, the coil slide device is provided with a slide that is normally held in place by a stop of some type that is disengaged when the appropriate coins are utilized and that then permits the slide to move into a position where the coins will drop out of the slide and the machine will become operative. A common security problem arises in that, when the equipment is situated in essentially unsupervised locations, persons may utilize excessive force on the handle, for example by hammering, to attempt to cause the disengagement of the stop mechanism, usually by breaking or deforming the stop, and thereby enable the slide to move into an operative position. Such a situation is serious not only because the device is broken and the services of the machine are immediately obtained without pay, but also because the malfunction of the stop mechanism is not necessarily readily detectable by the owner of the vending equipment. Thus, the slide can be continually pushed back and forth on subsequent occasions by various patrons to render the machine operative and a substantial amount of revenue can be lost by the machine owner.

SUMMARY OF THE INVENTION

An object of the present invention is to provide a security stop which becomes engaged only when excessive force is applied to the coin slide handle which would otherwise be sufficient to break the normal stop mechanism employed in coin operated machines. In particular, an object of the invention is to provide a stop mechanism that is constructed to resist those forces which could reasonably be applied to activate the mechanism without paying.

These and other objects are attained in accordance with the invention in a coin accepting mechanism of the type having a first slide movable between a normal checked position in which the vending machine is locked out of service and a coin-activated operative position at which the coins are accepted and the vending machine is placed in service. The jamming mechanism, includes a second slide having a handle engageable and operable by a user of the vending machine, and a mechanism for releasably interconnecting the first and second slides. The interconnecting mechanism prevents relative movement between the two slides when a normal amount of force, such as when a user is properly inserting coins, is applied to the second slide. In this condition, when the proper coins are inserted, the second slide controls the movement of the first slide from the checked position to the operative position and the vending machine is made operative. The interconnecting means enables relative movement between the two slides upon application of a force greater than a predetermined amount, such as by the use of a hammer or a crowbar on the second slide. When this occurs, a stop device is activated so that the second slide is no longer able to move the final slide.

DESCRIPTION OF THE PREFERRED EMBODIMENT

The jamming mechanism of the present invention may be utilized in any coin-operated device which is activated by a mechanical coin slide mechanism which is formed to accept one or more coins.

Figure 1:
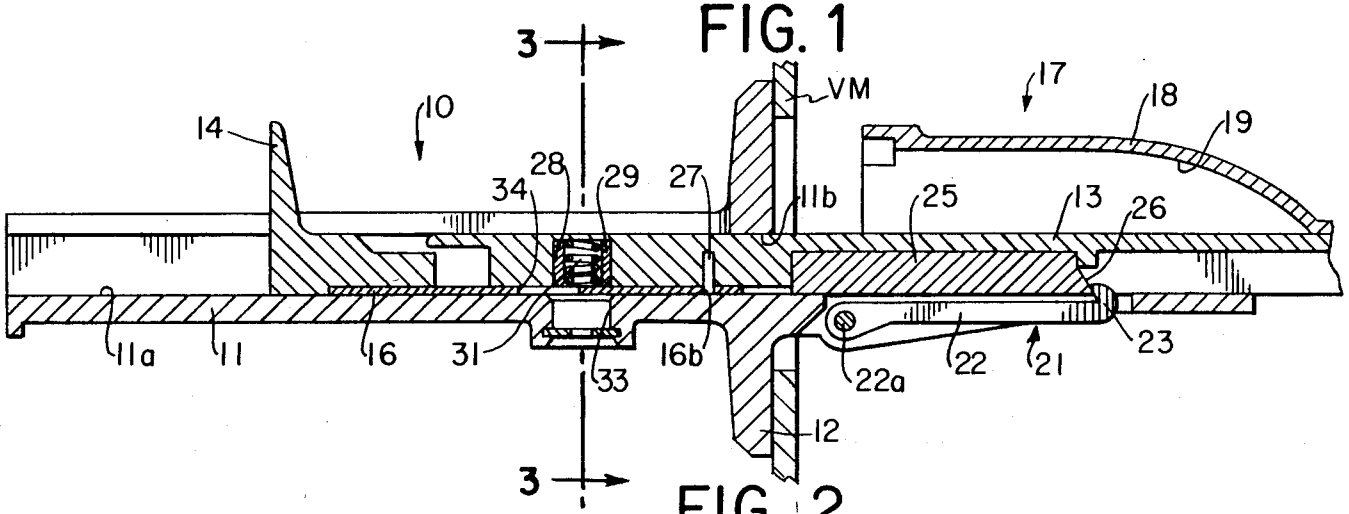
FIG. 1 is a longitudinal section taken along the line 1—1 of FIG. 3 showing a jamming mechanism according to the invention in the normal standby coin receiving condition.
Figure 2:
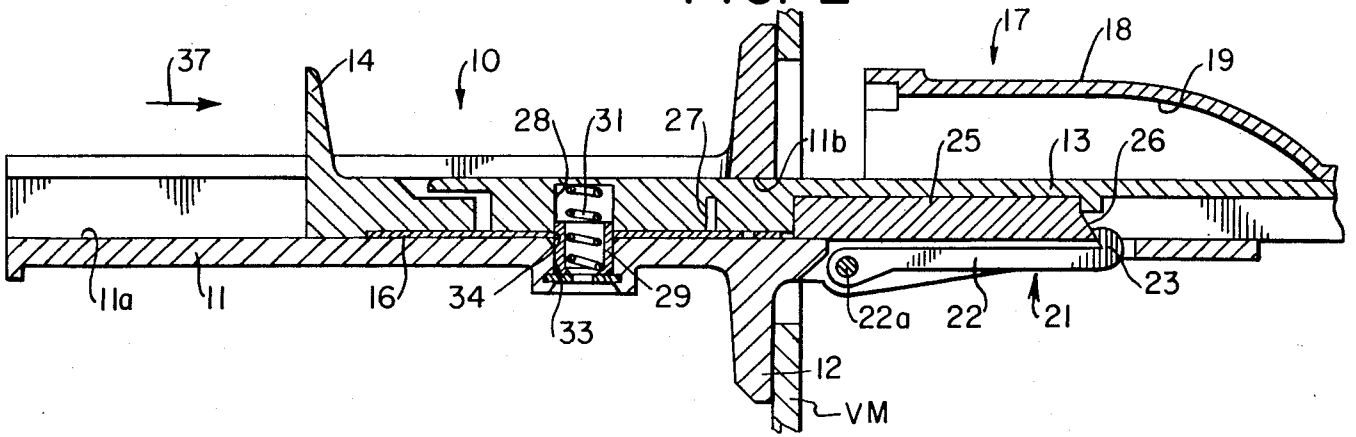
FIG. 2 is a similar longitudinal section showing the jamming mechanism in the actuated condition.
Figure 3:
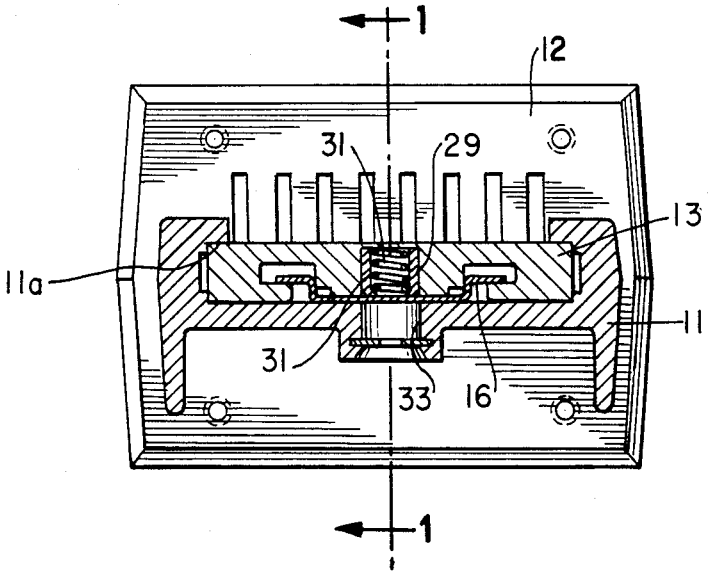
FIG. 3 is a cross section taken along the line 3—3 of FIG. 1.

As seen in FIGS. 1-3, the coin slide mechanism 10 which includes the jamming mechanism of the invention has a body portion 11 provided with a mounting flange 12 for securing it to a wall of an appropriate vending machine VM (only a portion of which is shown) in a manner which is well known to persons of ordinary skill in the art. The body 11 may be machined or cast by any conventional technique.

The body 11 is provided with a slide track **11*a* that extends through an opening 11*b* in the mounting flange 12. A first slide 13 and a second slide 14 having a slide handle 14*a* is mounted for reciprocal movement in the slide track 11*a*. The first slide 13 extends through the opening 11*b* in the mounting flange 12. A first slide 13 and a second slide 14 having a slide handle 14*a* is mounted for reciprocal movement in the slide track 11*a*. The first slide 13 extends through the opening 11*b* in the mounting flange 12** and into the vending machine VM.

The slides 13 and 14 are operably interconnected by a shear plate 16 which is permanently affixed to the second slide 14 and is adapted to ride within the slide track **11*a*. In the preferred embodiment, the shear plate 16 is affixed at the lower side of the second slide 14 and rides along the bottom of the slide track 11*a*. The shear plate 16 extends forwardly from the second slide 14 and overlaps a portion of the lower face of slide 13**.

The shear plate 16 and the slide 13 are normally rigidly connected together but may be moved relative to one another under circumstances described below. The connection is made by a shear pin 27 which is mounted in the slide 13. The shear pin 27 has a portion which extends downward from the slide 13 and fits within a hole **16*b* (FIG. 1) formed in the shear plate 16. The shear pin 27 is fixed in place in slide 13 (see FIG. 1) by any suitable technique such as staking, welding, etc., and normally does not move relative to the slide 13 or the shear plate 16. The shear plate 16 is thus fixed to the slide 13 so that the second slide 14 and the slide 13 are moved together through the connection made by the shear plate as long as the shear pin 27** is intact.

The shear pin 27 is made of any suitable material, size, and/or shape such that it will break upon the application of a predetermined amount of force. The shear pin can, for example, be formed of either a solid or hollow piece of material if desired, which is weakened in a predetermined area so that it will break upon the application of the predetermined force.

The mechanism 10 has a generally conventional coin acceptance section 17 on the side of mounting flange 12 opposite the second slide 14 and within the vending machine VM. The coin acceptance section 17 includes the usual coin receiving openings adapted for coins of predetermined sizes. The coin receiving opening and acceptance mechanism can be of a type to receive the coins placed either horizontally or vertically. A vertical arrangement is shown in which each coin receiving opening has a curved bridge element 18 associated with it for the purpose of guiding the coins to a coin drop receiving section. Each bridge 18 is provided with an internally facing cam or bearing surface 19 which presses inwardly on accepted coins as is well understood by those skilled in the art. The coins are checked for size at the inlet 18*a* to the bridge section. A more complete description of vertical mechanisms for accepting, checking and guiding the coins is contained in, for example, U.S. Pat. Nos. 3,978,960 and 4,098,385.

A lever checking mechanism 21 is connected to the body portion 11 on the side of mounting flange 12 opposite the second slide 14 and within the vending machine. The lever checking mechanism includes one or more lever arms 22, generally one for each of the coins being accepted, mounted by a pivot 22*a* on the body 11 immediately below the slide 13. Each of the lever arms 22 is provided with a slide stop, or dog 23, and is biased by a spring (not shown) to pivot in the direction of the slide 13. This mechanism may for example be the same as or similar to that disclosed in the aforesaid patents and is not disclosed in detail here.

The slide 13 includes a coin receiver block 25 having a locking edge 26 which protrudes downward from the slide 13 and in the direction of the slide stop(s) 23 on the lever 22. The locking edge 26 is adapted to engage a slide stop 23 when its respective lever 22 is held in its upper position as a result of the upward bias normally applied to it. When the lever 22 is in that position, the slide 13 is held in place and is not intended to move unless a coin of proper size is inserted. The vending machine being operated by the coin slide mechanism therefore is protected against unauthorized use or theft of services so long as the slide stops 23 of the set of levers corresponding to the coins to be accepted and the locking edge 26 are in engagement.

In normal operation, the proper coin, or coins, are inserted in one or more slots on the slide 13 when it is on its left most position (not shown on the drawings). The handle 14*a* is moved to the right which in turn moves the slide 13 to the right due to the connection provided by the shear plate 16. The coins are checked for size at the entrance 18*a* to the bridge 18 and, if proper, the slide 13 can be moved further to the right by further movement of handle 14*a*. The levers 22 are then depressed by the one or more coins, and the leading edge 26 of the slide will clear the lever stops 23. The coins are then be guided by the bridge 18 to drop into the receiving section (not shown). The vending machine will then be actuated. This arrangement is conventional.

The problem that this invention addresses arises when, the proper coin or coins not having been inserted, a user attempts to apply enough force to the slide mechanism, usually through the handle 14*a* of the second slide 14 to cause the force at the juncture between the locking edge 26 of the receiver block 25 and the stops 23 to be great enough to break or deform the stops 23. If this occurs, the slide 13 would move further to the right thereby activating the mechanism controlled by the coin slide device and permitting the services of the equipment to be utilized without payment.

In the preferred embodiment of the invention, a recess 28 is formed in the slide 13. A rugged, retractable lock pin 29 is normally housed within the recess 28. The lock pin 29 is biased towards an extended, or jamming, position by a spring 31. In the preferred embodiment, the lock pin 29 is hollow and is formed with an inwardly turned retaining lip 29*a* at its bottom edge. The spring 31 is located in the pin's hollow interior and its top coil engages the lower face of the slide 13 in the recess 28 while its bottom coil engages the retaining lip 29*a*. A permanent outward (downward) bias is thereby provided on the lock pin 29.

The lock pin 29 is held in a retracted position (FIG. 1) within the recess 28 by engagement with the shear plate 16, which is normally situated so that it covers a part of opening of recess 31 and thereby engages at least a part of the lock pin 29. Under normal circumstances therefore, the slide 13, the shear plate 16 and the slide handle 14 move back and forth together within the slide track 11*a* formed in the body portion 11 of the mechanism 10 and the lock pin will have no effect.

The body portion 11 is formed with a recess, or bore, 33 which is of a size and shape appropriate to permit entry of the lock pin 29. The recess 33 is situated directly opposite the lock pin 29 when the slide 13 is situated in the unactivated position defined by engagement between the stops 23 and the locking edge 26 of the coin receiver block 25. When released, the lock pin 29 projects into the recess 33 when it is in its extended position under the bias of the spring 31. The lock pin 29 and recess 33 have mating shapes so that the pin can extend into the recess and be held firmly therein. The lock pin 29 is of a material which has strength sufficient to withstand all unauthorized forces which may be applied to the slide 14 or its handle 14*a*.

The shear plate 16 has a hole 34 that lies along the longitudinal axis of the slide track 11*a*. The hole 34 partially overlies the lock pin 29 when the shear plate 16 is fixed in position relative to the slide 13, as in FIG. 1. The size and shape of the hole 34 is adapted to accommodate the lock pin 29 so that when the lock pin 29 is permitted to move to its extended position, it extends through the hole 34, as shown in FIG. 2, and into the recess or bore 33 on the body portion 11.

The shear pin 27 is designed to be sheared off when the excessive force is applied in either direction to the second slide 14 or its handle 14*a*. The material of the shear plate 16 has a greater resistance than that of the shear pin 27 so that under conditions of excessive applied force, the shear plate 16 shears or breaks off the shear pin 27 thereby permitting the second slide 14 to move relative to the slide 13. Since the shear plate 16 is rigidly fixed to the second slide 14, movement of the slide handle 14*a* relative to the slide 13 also causes the shear plate 16 to move relative to the slide 13.

In FIG. 2, the jamming mechanism is shown in its actuated position. This position is reached when excessive force is applied to the second slide 14 or its handle 14*a* to move it to the right. This occurs when the mechanism is sought to be operated without the insertion of the proper size coins such as by applying force with a hammer, for example, directed to the right in FIG. 2, as shown by an arrow 37. In this case, in the absence of the present invention, the force might be adequate to break or deform the pivoted lever 22 and the stops 23.

FIG. 1 shows the coin slide at the position just prior to where the coins would move into the coin checking section 18*a* where the dogs 23 would be released. Assume that there are no coins in the slide and that an unauthorized user applies force to the handle 14*a* directed to the right of an amount such that the the shear pin 27 is broken. Since the shear plate 16 is no longer connected to the first slide 13, further movement of handle 14*a* to the right will move the second slide 14 to the right to close the gap between it and the left end of the slide 13. The shear plate 16 moves to the right along with the second slide and the shear plate hole 34 moves directly under the retracted lock pin 29. As it does so, the outward bias of the spring 31 causes the lock pin 29 to extend through the shear plate hole 34 and into the recess 33 in body. When this occurs, the excessive forces which would otherwise be applied to the slide handle 14 are now absorbed by the lock pin 29. This force is transmitted through the lock pin 29 to the relatively rugged body portion 11 and to the heavy metal casing of the vending machine VM. Since the lock pin 29 is constructed to withstand large forces, this prevents the slide 13 from being moved to a position to release the dogs 23 so that the vending equipment cannot be activated.

Force may also be produced by a crowbar, for example, and may be directed to the left in FIG. 2. This might occur when coins which have pieces of tape on them are trapped in the bridge section 18 and the slide 13 cannot be moved back to the left using normal hand force. This is done when a user tries to actuate the levers 22 without having the coins collected.

After the shear pin 27 is broken by applying a force to the left, and the plate 16 is now free to move to the left, and the second slide 14 is now free to move relative to slide 13. The second slide 14 and shear plate 16 become detached from the remainder of the apparatus. In this case the lock pin 29 enters the bore 33. Once this occurs, the handle 14 and shear plate 16 cannot be reinserted into the track 11*a* since the shear plate will still be attached to the second slide 14 and it will engage and be blocked by the extended lock pin 29.

Figure 4:
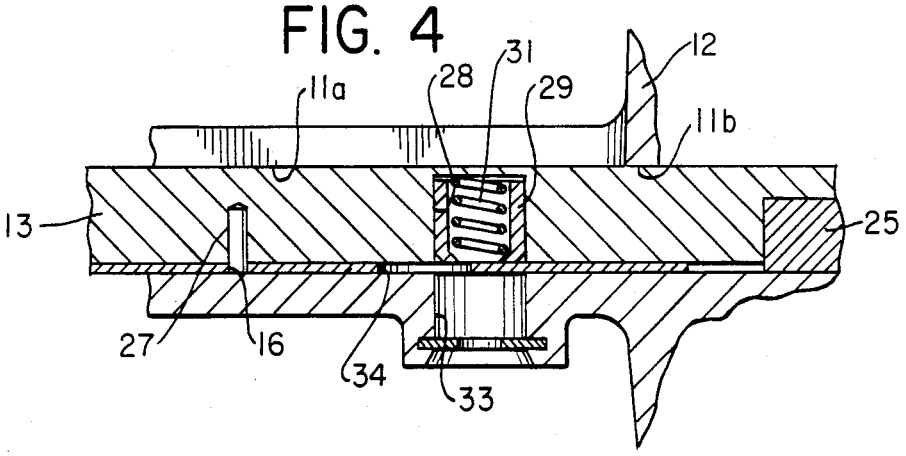
FIG. 4 is an enlarged fragmentary longitudinal section of an alternative embodiment of the invention.

In an alternative embodiment shown in FIG. 4, the positions of the shear pin 27 and lock pin 29 are substantially interchanged as compared to FIG. 1 so that the shear pin 27 is closer to the second slide handle 14*a*. In both embodiments, the application of excessive force, whether directed to the left, as by a crowbar, or to the right, as by a hammer, will cause the shear pin 27 to break and the lock pin 29 to enter the bore 33 when the handle is thereafter moved to the left or right as the case may be.

In another embodiment, not shown, a pair of holes 34 located in shear plate 16 may be placed respectively on opposite sides of the lock pin 29, along the path of movement of the slide 13. In this embodiment, regardless of whether excessive force is directed inwardly (to the right in FIGS. 1, 2 and 4), as by a hammer, or outwardly (to the left in FIGS. 1, 2 and 4), as by a crowbar, so as to fracture the shear pin 27 and permit the shear plate 16 to move, one of the shear plate holes 34 will move under the stop pin 29 and release it into the recess 33. This will lock the second slide. In this embodiment, if force is applied to the left, the second slide will be retained in the mechanism.

In still another embodiment, not shown, the same result is achieved by providing a single recess 33 and shear plate hole 34 and a pair of lock pins on slide 13, each similar to the lock pin 29 respectively, placed on a opposite sides of the recess 33, along the path of movement of the slide 13.

It will be clear to persons of ordinary skill in the art that the lock pin 29 can be provided either in the slide 13 or in the body portion 11. In the latter case, the lock pin will be biased to move upwardly into a recess into slide 13.

The shear plate 16 is shown for purposes of illustration as riding along the bottom of the coin slide track 11*a* in the body portion 11. The shear plate 16 need not be a plate nor need it be located in precisely the position illustrated in FIGS. 1–3. For example, it can be a bar or strip. The fundamental concept is that there must be relative movement between two portions of the actuating mechanism under conditions of excessive force so as to thereafter permit a lock pin to act as a stop and to transfer to the body portion of the device the excessive force being applied. The scope of the present invention is intended to include modifications of that type which do not depart from its spirit.

Although the invention has been described with some particularity, it should be understood that the present specification includes only examples of embodiments of the invention and that additional changes or modifications in the combination or arrangement of the various components of the mechanism may be resorted to without departing from the spirit or the scope of the invention as set forth in the following claims.

What is claimed is:

1. A jamming mechanism for a coin-operated vending machine, the mechanism comprising:

a first slide movable between a normal checked position in which said vending machine is locked out of service and a coin-activated operative position in which said vending machine is placed in service;

a second slide engageable by a user of the vending machine;

means for releasably interconnecting said first and second slides to prevent relative movement therebetween in the absence of a predetermined force applied to said second slide whereby the proper coin or coins having been inserted, said second slide can be used to control the movement of said first slide from said checked position to said operative position, and to enable relative movement therebetween upon application of said predetermined force, said interconnecting means including a breaking member affixed to one of said slides and releasably attached to the other of said slides, said other of said slides including a breakable element in engagement with said breaking member, said breaking member including a plate overlapping both said first and second slides and adapted to move with said one slide relative to said other slide upon application of said predetermined force upon breaking of said breakable element;

stop means for preventing movement of at least said first slide upon appliction of said predetermined force, said stop means including a lock pin movable between a retracted and a jamming position, said lock pin being spring biased toward said jamming position; and a body portion adapted to be secured to said vending machine and forming a track for said slides and in which said lock pin engages both said first slide and said body portion when said lock pin is in said jamming position.

2. The mechanism of claim 1 in which said plate overlies the lock pin to retain it in its retracted position in the absence of said predetermined force.

3. The mechanism of claim 2 in which said plate is provided with at least one opening closely spaced apart from the lock pin, said opening being positioned along the path of movement of the plate relative to the lock pin upon application of said predetermined force so that the lock pin moves to its jamming position when said opening is moved in alignment therewith.

4. The mechanism of claim 3 in which said lock pin is located in said first slide and said body portion is provided with a recess opposite the lock pin to receive the lock pin in its jamming position.

5. The mechanism of claim 4 in which said lock pin is hollow and open at its inner end further comprising a coil spring extending through said open inner end and engaging said lock pin for biasing said lock pin towards said jamming position.

* * * * *